United States Patent [19]

Cliff et al.

[11] 4,256,551

[45] Mar. 17, 1981

[54] ELECTROLYTIC PROCESS

[75] Inventors: Michael J. Cliff, Elton near Chester; William T. Cross, Cuddington; Colin Ramshaw, Norley, all of England

[73] Assignee: Imperial Chemical Industries Limited, London, England

[21] Appl. No.: 87,569

[22] Filed: Oct. 23, 1979

[30] Foreign Application Priority Data

Nov. 2, 1978 [GB] United Kingdom ..... 42888/78

[51] Int. Cl.[3] ..... C25B 1/14; C25B 1/26; C25B 11/03

[52] U.S. Cl. ..... 204/98; 204/278

[58] Field of Search ..... 204/98, 266, 278

[56] References Cited

U.S. PATENT DOCUMENTS

| | | | |
|---|---|---|---|
| 1,056,181 | 3/1913 | Jewell | 204/98 |
| 1,100,290 | 6/1914 | Dow | 204/98 |
| 3,893,897 | 7/1975 | Raetzsch | 204/98 |
| 3,976,550 | 8/1976 | De Nora | 204/98 |

FOREIGN PATENT DOCUMENTS

| | | |
|---|---|---|
| 1348785 | 3/1974 | United Kingdom . |
| 1451399 | 9/1976 | United Kingdom . |
| 1451400 | 9/1976 | United Kingdom . |
| 1480343 | 7/1977 | United Kingdom . |

OTHER PUBLICATIONS

J. Applied Electrochemistry, 1972, 2, pp. 59–69.

J. Pure and Applied Chemistry, 1974, 5, pp. 111–136.

*Primary Examiner*—T. Tufariello

*Attorney, Agent, or Firm*—Cushman, Darby & Cushman

[57] ABSTRACT

A process for electrolysing at least a proportion of a liquid comprising an electrolyte which process comprises passing the liquid between electrodes, at least one of which is an anode and at least one of which is a cathode, the liquid being in a state of laminar flow substantially parallel to the electrodes, the electrodes being disposed substantially horizontally above each other and each electrode being permeable to the product(s) or solutions thereof produced at or adjacent the electrode and, where a density difference is generated on production of the products, the relative disposition of the electrodes is such that the density difference reduces the possibility of the product(s) produced at or adjacent the anode mixing with the product(s) produced at or adjacent the cathode. The process is especially applicable to the electrolysis of brine.

15 Claims, 4 Drawing Figures

ELECTROLYTIC PROCESS

This invention relates to electrochemical processes, particularly to electrolytic processes and to apparatus in which such processes are carried out.

In the electrolysis of an electrolyte in a liquid in an electrolytic cell, often a porous partition, typically a permeable membrane, is dispoed between the anode and the cathode to prevent or reduce the product(s) produced at the anode mixing or reacting with the products(s) produced at the cathode. Moreover where an electrolytic product is immiscible with the liquid it often forms a polarising layer on the electrode at which it is produced, which layer hinders or interrupts the electrolysis. We have now found that where the liquid flows under conditions of laminar flow substantially parallel to the surface of substantially horizontal electrodes, these problems can be alleviated by employing electrodes which are permeable to the product(s) or solution(s) thereof produced at or adjacent the electrodes.

Accordingly, the present invention provides a process for electrolysing at least a proportion of a liquid comprising an electrolyte which process comprises passing the liquid between electrodes at least one of which is an anode and at least one of which is a cathode, the liquid being in a state of laminar flow substantially parallel to the electrodes, the electrodes being disposed substantially horizontally above each other and each electrode being permeable to the product(s) or solutions thereof produced at or adjacent the electrode and, where a density difference is generated on production of the products, the relative disposition of the electrodes is such that the density difference reduces the possibility of the product(s) produced at or adjacent the anode mixing with the product(s) produced at or adjacent the cathode.

While the liquid may be a molten electrolyte preferably it is a solution or dispersion of the electrolyte in a suitable solvent.

By "electrolyte" we mean a substance which in a suitable solvent or gel or as a melt gives rise to at least one anion and at least one cation. An electrolyte may be a so-called "strong" electrolyte, i.e. an electrolyte which contains a stable ionic bond and is substantially wholly ionised in solution. An electrolyte may be a so-called "weak" electrolyte, i.e. an electrolyte which contains a covalent bond which may be transformed into an ionic bond such that a solution of the electrolyte in a suitable solvent or a melt of the electrolyte contains ionic and covalent bonds in dynamic equilibrium. Electrolytes are typically acids, bases or salts.

By "electrolysis" we mean the decomposition of an electrolyte by the passage of an electric current through a solution or a melt of the electrolyte such that at least one anion migrates to an anode to lose at least a proportion of its charge and at least one cation migrates to a cathode to lose at least a proportion of its charge.

Throughout this specification, where reference is made to "electrode", "anode" or "cathode" such expressions are intended to include the case where a plurality of anodes and/or cathodes are present.

By laminar flow we mean flow of a liquid in parallel layers in contact with each other with little or no fluctuation or turbulence disturbing the layers.

By "product produced at or adjacent an electrode" we mean (a) the uncharged atom or group which may be deposited on or liberated at the electrode to which an ion migrates and gives up its electric charge, e.g. an anion migrates to an anode and loses an electron to the anode, and a cation migrates to a cathode and accepts an electron from the cathode, or (b) a product formed when the uncharged atom or group reacts chemically with the electrode, a solvent (where it is present), or with a substance present in the liquid.

The permeable electrodes may be formed of parallel, woven, knitted or sintered fibres, sintered particles, perforated plate, expanded metal or a skeleton foam, or mechanical assemblies thereof. Preferably the electrode is a woven mesh or a plurality of parallel fibres or an expanded metal. Preferably the "pores" of such electrodes or, where parallel fibres are employed the distance between fibres, are smaller than the distance between the anode and the cathode.

The material of the electrodes will necessarily be electrically conducting and will be chosen with regard to the liquid and product(s) which they are to contact and the mechanical stresses to which they are to be subjected. Suitable materials are well known in the electrolytic art and choice of suitable materials will present no problem to the skilled man. As examples we would mention a nickel or mild steel cathode and a titanium anode for the electrolysis of an alkali metal halide brine, e.g. sodium chloride brine. It will be appreciated that to facilitate disengagement of a product from an electrode the electrode may have a suitable surface treatment which inhibits the product wetting the electrode. It will be appreciated that to facilitate discharge of ions at an electrode it may have a suitable surface treatment. However, such treatments should not catalyse or facilitate an undesirable reaction. For example, in the electrolysis of brine the anode may be treated with titanium/ruthenium oxides which facilitate the discharge of chloride ions but does not give a sufficiently high over-voltage for the production of oxygen.

For a given liquid at a given temperature and a given rate of flow, the upper limit of the distance between the anode and the cathode (the anode/cathode gap) is dictated by the Reynolds Number at which turbulence sets in and by the acceptable ohmic drop between the anode and the cathode. Likewise as the anode/cathode gap is decreased the practical difficulty of maintaining them parallel increases and imposes a lower limit on the said gap. Preferably the anode/cathode gap is between 0.1 mm and 2 cm, more preferably between 0.5 mm and 4 mm.

As electrolysis proceeds the density of the liquid in the region of the electrodes may change and the change of density may be different in the region of the anode to that in the region of the cathode. The change in the density of the liquid in the region of an electrode is dependent inter alia on the loss of electrolyte from the said region and on the nature of the product produced in the said region, e.g. its miscibility or lack of miscibility with the liquid.

The voltage drop between the anode and the cathode due to the ohmic resistance of the solution, where a solution is employed, will depend inter alia, on the particular electrolyte present and on the ionic concentration thereof. Furthermore, it will be appreciated that in order to reduce energy consumption the voltage drop is kept as low as possible commensurate with an acceptable rate of production of products. The voltage drop may be reduced by increasing the ionic concentration of the electrolyte or by increasing the temperature. This may necessitate operating at the saturation concentration of an electrolyte in a solvent. For example, the electrolysis of sodium chloride is typically effected in saturated brine.

A product of the process of the present invention may be a gas, a liquid or a solid. The process may be operated under conditions of temperature and pressure such that the product, where it is a gas at ambient temperature and pressure, is produced as a liquid. For example, where chlorine is produced at the anode by the electrolysis of an alkali metal chloride brine the temperature of the brine is kept in the range 10° C.-100° C., preferably in the range 30° -50° C., and the pressure is kept in the range 50 to 750 psi, preferably in the range 130-500 psi such that the chlorine is obtained as a liquid.

Where a change in density occurs in the region of an electrode the relative disposition of the electrodes is chosen such that the change in density reduces the possibility of the product (s) produced at or adjacent the said electrode mixing with the product produced at or adjacent the electrode of opposite polarity. For example, where the density of a product or solution thereof produced at or adjacent a cathode has a density lower than that of the liquid, the cathode is disposed above the anode, e.g. where brine flows horizontally between an anode and a cathode, the cathode is made the upper electrode such that hydrogen produced may be readily disengaged from the liquid. Moreover, where the electrolysis of brine is effected under conditions of temperature and pressure such that liquid chlorine is produced, which has a higher density than that of brine or caustic soda, disposition of the anode below the cathode further reduces the possibility of the products mixing.

When liquid product e.g. liquid chlorine is produced at the lower electrode it is preferred that the depth of liquor below the lower electrode should increase through the cell in the direction of liquid electrolyte flow. Conveniently, this may be achieved by sloping the base of the cell downwardly towards the outlet for the liquid product.

Where a gas is produced at the upper electrode the depth of the liquid above the upper electrode is preferably kept to a minimum to allow ready disengagement of the gas. For example in the electrolysis of brine the depth of liquid above the upper electrode (the cathode) is preferably between 0.2 mm and 3 mm, more preferably between 0.5 mm and 1.5 mm, to allow ready disengagement of the hydrogen produced at the cathode. We have found that where a gas is produced at the upper electrode the height of liquid above the upper electrode may conveniently be kept at a pre-set height by positioning the gas take-off port at the pre-set height with liquid discharging through the gas take-off port such that if the rate of flow of liquid increases the pressure of the gas produced forces excess liquid out of the gas take-off port.

It will be appreciated that the density of the layers of liquid adjacent the electrodes may be altered by imposing a temperature gradient on the cell in which the process of the present invention is carried out which temperature gradient may reduce the possibility of a product produced at or adjacent the anode mixing with the product produced at or adjacent the cathode. For example, where brine is electrolysed as it flows horizontally between the electrodes the upper of which is the cathode, the region of the cathode is preferably heated to lower the density of the caustic soda produced in the said region so that the possibility of the caustic soda drifting to the anode is reduced. The distance over which the liquid flows in contact with the electrodes in the process of the present invention is dependent inter alia on the rate of flow of liquid, and on the current density, i.e. the faster the rate of flow the longer the cell and the higher the current density the shorter the cell. At convenient rates of flow and current density the length of the cell is typically between 5 and 50 cm, preferably between 15 and 30 cm. The current density employed will depend on the reaction occurring in the cell and for the electrolysis of brine we have found that current densities between 0.1 and 2.0 amp/cm$^2$ and preferably between 0.2 and 0.6 amp/cm$^2$ may be employed.

The rate of flow of the liquid is chosen such that it is sufficient to produce product(s) at an acceptable rate, to maintain a suitable temperature in the cell, and to maintain laminar flow.

The electrolytic process according to the present invention may be employed inter alia in the production of chemicals, e.g. hydrogen, oxygen, hydrogen peroxide, chlorine caustic soda, fluorine; in the extraction of metals from molten salts, e.g. aluminium, magnesium, sodium and from solutions of metal ores, e.g. copper, zinc, cadmium.

The invention will be further described by reference to the accompanying drawings which show, by way of example only, two chlorine cells suitable for use in the process of the present invention. In the drawings.

Figure 1:
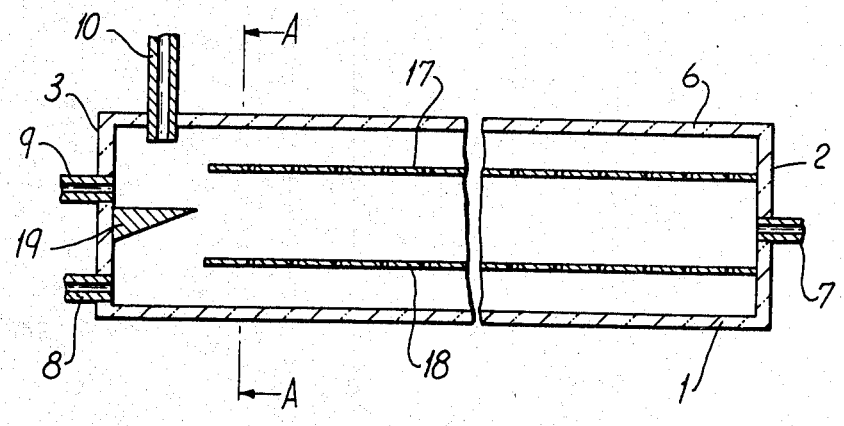
FIG. 1 is a vertical longitudinal section through a first cell.
Figure 2:
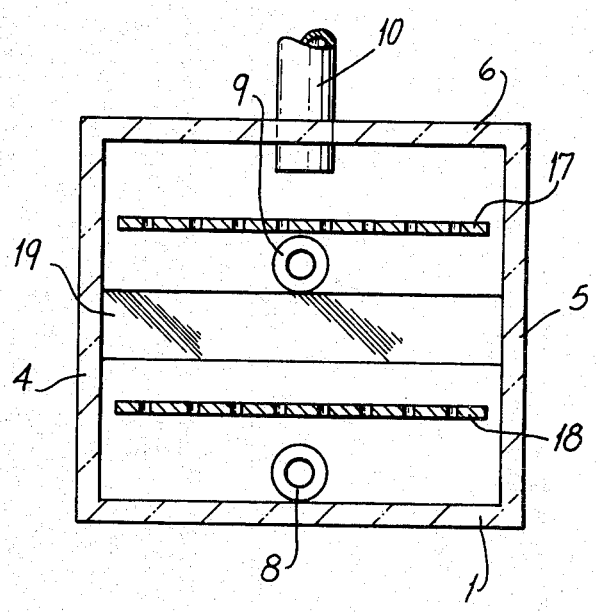
FIG. 2 is a cross-section on the line AA of FIG. 1 to a different scale.
Figure 3:
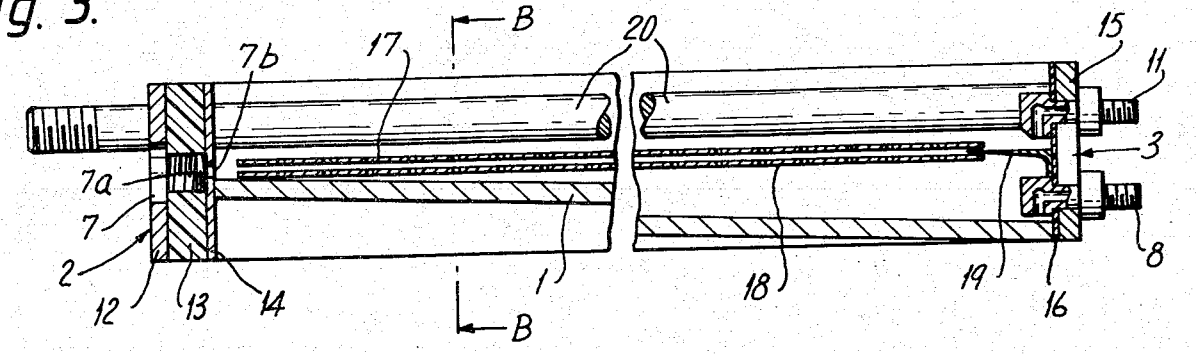
FIG. 3 is a vertical longitudinal section through a second cell having a modified exit port and showing further details of construction.

Referring to FIGS. 1-4, each cell is provided with a baseplate 1, end walls 2,3 (shown diagrammatically in FIG. 2 and in more detail in FIG. 4), sidewalls 4,5, and a separate cover 6 (as shown in FIGS. 1 and 2) but which may alternatively be effected by superimposing two cells (of the type shown in FIGS. 3 and 4) on top of one another. The baseplate 1, end walls 2, 3, sidewalls 4, 5 and cover 6 are suitably fabricated of glass or silica. The baseplate 1 slopes downwardly (as shown in FIG. 3; not shown in FIG. 1) from side wall 2 to end wall 3 at a shallow angle, for example at an angle to the horizontal of from 1° to 10° typically 2°.

Each cell is provided with an inlet port 7 for sodium chloride brine, and an outlet port 8 for liquid chlorine. The inlet port 7 (as shown in FIG. 3) is conveniently connected with a header **7*a* from which it is fed to the cell through a plurality of ports 7*b*. The cell shown in FIGS. 1 and 2 has an outlet port 9 for sodium hydroxide solution and an outlet port 10 for hydrogen. The cell shown in FIGS. 3 and 4 has a single outlet port 11 for both sodium hydroxide solution and hydrogen. The inlet port 7 and the outlet ports 9, 10, 11 are typically of mild steel, and the outlet port 8** is typically of titanium.

The end wall 2 (as generally indicated in FIG. 3) typically comprises a mild steel end plate 12, a block or slab 13 of plastics material (e.g. polyvinyl chloride, polytetrafluoroethylene) and a thin sheet 14 of titanium provided with ports **7*b* connecting with header 7*a* and inlet port 7 (as generally indicated in FIG. 3). The end wall 3 (shown in FIG. 3) typically comprises a mild steel end plate 15, and a sheet 16** of plastics material (e.g. polyvinyl chloride, polytetrafluoroethylene).

A cathode 17 is typically formed of nickel or mild steel mesh. Anode 18 is typically formed of titanium mesh and is provided with an electrocatalytically active coating, for example a coating comprising a mixture of ruthenium oxide and titanium dioxide. A splitter 19, typically of titanium serves to vary the flow of brine over the anode and cathode surfaces respectively.

Figure 4:
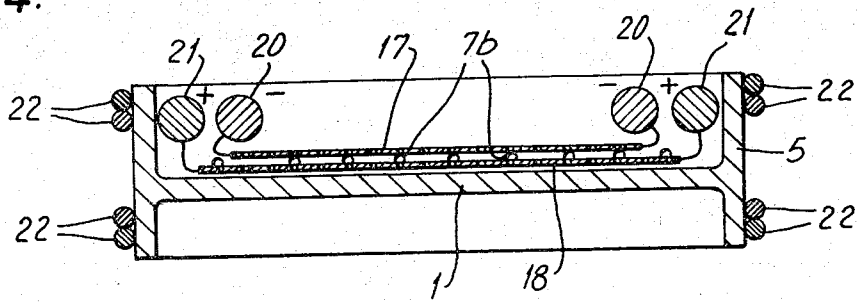
FIG. 4 is a cross-section on the line BB of FIG. 3.

Current is fed to the cathode 17 by means of copper busbars 20 and to the anode 18 by means of copper busbars 21 (as shown in FIGS. 3 and 4; the electrical leads are not shown in FIGS. 1 and 2). The busbars 20, 21 may be connected to the cathode 17 and anode 18 by any convenient means, for example by brazing or clamping, and may be protected from conditions within the cell environment by suitably plating, for example with nickel.

The end plates 2, 3 are conveniently held together by means of tie rods 22 (as shown in FIG. 4) typically of mild steel.

In the electrolysis of brine in the cell, brine (6N) at a temperature of 30° C. flows in through port 7 to develop a pressure of 150 to 250 psi, e.g. 200 psi, in the cell and flows through the cell under conditions of laminar flow. Chlorine produced at the anode 18 is formed as a liquid and falls to the bottom of the cell and is expelled from the cell via port 8 along with brine. Sodium hydroxide solution is produced at cathode 17 and is discharged with brine through port 9 (FIG. 1) or port 11 (FIG. 3). Hydrogen is produced at the cathode; it collects at the top of the cell and escapes through port 10 (FIG. 1) or port 11 (FIG. 3). The pressure of hydrogen can be used to keep the level of liquid in the cell below a pre-set height indicated by the dotted line in FIGS. 1 and 3, e.g. if the flow of brine increases so that the level tends to rise above the dotted line, the pressure of the hydrogen forces excess brine out through the port 10 (FIG. 1) and port 11 (FIG. 3).

The invention is further illustrated by the following Example relating to the electrolysis of sodium chloride brine.

EXAMPLE

The cell (20 cm long and of cross-section 2 cm by 2 cm) was provided with a titanium mesh anode coated with a mixture of ruthenium oxide and titanium dioxide and a titanium mesh cathode which was similarly coated (the coating served to protect the titanium cathode from hydrogen attack).

6N sodium chloride brine was passed between the electrodes at a rate of 70 ml/min (split approximately 40 ml/min to the anode surface and 30 ml/min to the cathode surface). The cell was maintained at a pressure of 205 psi, and operated at 3.4 volts initially (which gradually increased to 3.7 volts over 3 hours) and at a current density of 0.25 amp/cm$^2$. The anode/cathode gap was 4 mm and the depth of brine above the cathode was about 1.5 mm. Liquid chlorine and dissolved chlorine, totalling 0.088 M in brine, was discharged from the bottom of the cell. Sodium hydroxide (0.01 M in brine), hydrogen and chlorine (0.01 M in brine) were discharged from the top of the cell.

What we claim is:

1. A process for electrolysing at least a proportion of a liquid comprising an electrolyte which process comprises passing the liquid between electrodes, at least one of which is an anode and at least one of which is a cathode, the liquid being in a state of laminar flow substantially parallel to the electrodes, the electrodes being disposed substantially horizontally above each other and each electrode being permeable to the product(s) or solutions thereof produced at or adjacent the electrode and, where a density difference is generated on production of the products, the relative disposition of the electrodes is such that the density difference in combination with laminar flow of the liquid reduces the possibility of the product(s) produced at or adjacent the anode mixing with the product(s) produced at or adjacent the cathode.

2. A process as claimed in claim 1 wherein the anode/cathode gap is between 0.1 mm and 2.0 cm.

3. A process as claimed in claim 2 wherein the anode/cathode gas is between 0.5 mm and 4 mm.

4. A process as claimed in any one of the preceding claims wherein each electrode comprises a woven mesh or a plurality of parallel fibres or an expanded metal.

5. A process as claimed in claim 4 wherein the pores of the electrode or, where parallel fibres are employed, the distance between fibres, are smaller than the anode/cathode gap.

6. A process as claimed in any one of the preceding claims wherein the electrodes are disposed so that the product(s) or solutions thereof produced at or adjacent to the lower electrode having a density which is greater than that of the liquid or other liquid product(s) and so that the product(s) or solutions thereof produced at or adjacent to the upper electrode have a density which is lower than that of the liquid or other liquid product(s).

7. A process as claimed in any one of the preceding claims wherein a temperature gradient is imposed between the electrodes to reduce the possibility of the product(s) or solutions thereof produced at or adjacent to the anode mixing with the product(s) or solutions thereof produced at or adjacent to the cathode.

8. A process as claimed in any one of the preceding claims wherein the pressure and temperature are such that at least one of the products produced at the lower electrode, which is a gas at ambient temperature and pressure, is produced as a liquid having a density greater than that of the liquid or other liquid product(s).

9. A process as claimed in claim 8 wherein the electrolysis is carried out at a temperature in the range 10° C. to 100° C. and at a pressure within the range 50 psi to 750 psi.

10. A process as claimed in claim 9 wherein the electrolysis is carried out at a temperature in the range 30° C. to 50° C. and at a pressure within the range 130 psi to 500 psi.

11. A process as claimed in any one of claims 8 to 10 wherein the depth of liquor below the lower electrode increases through the cell in the direction of liquid electrolyte flow.

12. A process as claimed in any one of the preceding claims wherein at least one of the products produced at the upper electrode is a gas and wherein the depth of liquid above the upper electrode is kept to a minimum to allow ready disengagement of gas.

13. A process as claimed in claim 12 wherein the depth of liquid above the upper electrode is between 0.2 mm and 3 mm.

14. A process as claimed in any one of the preceding claims wherein the liquid is an alkali metal halide brine.

15. A process as claimed in claim 14 wherein the alkali metal halide is sodium chloride.

* * * * *